United States Patent [19]

Yoshizawa

[11] Patent Number: 5,000,439

[45] Date of Patent: Mar. 19, 1991

[54] SHEET CONVEYING APPARATUS AND IMAGE RECORDING APPARATUS HAVING SAME

[75] Inventor: Atsutomo Yoshizawa, Tokyo, Japan

[73] Assignee: Canon Kabushiki Kaisha, Tokyo, Japan

[21] Appl. No.: 270,069

[22] Filed: Nov. 14, 1988

[51] Int. Cl.[5] ..... B65H 5/06

[52] U.S. Cl. ..... 271/274; 226/176; 226/187

[58] Field of Search ..... 271/272, 273, 274, 253, 271/254, 255; 226/176, 177, 186, 191

[56] References Cited

U.S. PATENT DOCUMENTS 3,248,031 4/1966 Kilmartin ..... 226/194

FOREIGN PATENT DOCUMENTS 2347808 4/1974 Fed. Rep. of Germany ..... 271/274

63-8142 1/1988 Japan .

*Primary Examiner*—Richard A. Schacher

*Attorney, Agent, or Firm*—Fitzpatrick, Cella, Harper & Scinto

[57] ABSTRACT

A sheet conveying apparatus for conveying a sheet comprises a rotatable conveying roller for conveying a sheet, an intermediate roller engageable by the conveying roller, and a biasing roller mechanism shiftable between a bias position where the biasing roller mechanism abuts against the intermediate roller and a release position where the biasing roller mechanism is separated from the intermediate roller. The biasing roller mechanism is divided into a plurality of biasing rollers in accordance with widths of the sheets to be conveyed.

16 Claims, 10 Drawing Sheets

SHEET CONVEYING APPARATUS AND IMAGE RECORDING APPARATUS HAVING SAME

BACKGROUND OF THE INVENTION

1. Field of the Invention

The present invention relates to a sheet conveying apparatus for conveying a sheet in a predetermined direction, and to an image recording apparatus having the same.

The sheet described herein may be a recording sheet on which an image is recorded, a document sheet including an image to be read thereon, or the like.

Further, the image recording system described herein may be a copying machine, a printing apparatus, a word processor, an electronic typewriter, a facsimile system, or the like.

2. Related Background Art

FIG. 9 shows an example of an ink jet recording apparatus having a sheet conveying apparatus which has been previously proposed by the same applicant as the present application (but, not known yet).

In the ink jet recording apparatus shown in FIG. 9, a recording sheet 11 such as a paper, a film, a cloth or the like is fed by a feed roller 10 until a leading edge of the recording sheet is pinched by a nip between a conveying roller 1 and an intermediate roller 2. Then after the images included in one line corresponding to a lengthwise width of an array of recording elements, for example nozzles in the ink jet printer, are recorded on the recording sheet by scanning a head unit 7, the recording sheet is conveyed only by the conveying roller 1 by one pitch corresponding to the recording width. A motor M is provided for driving the conveying roller 1 through a belt transmission mechanism M and for driving the feed roller 10 through an appropriate transmission mechanism (not shown). While the recording sheet 11 is conveyed, it is closely contacted to a platen 8 by sucking air by an appropriate suction blower (not shown) through a plurality of small holes 9 formed in the platen.

Further, a biasing roller section 101 is provided for cooperating with the feed roller 10 to pinch the recording sheet 11 therebetween. The biasing roller section is divided into three rollers 101*a*, 101*b* and 101*c* to conform the width of various recording sheets. More particularly, the roller section is divided at positions corresponding to the longer widths of a A4 size sheet and of a A3 size sheet from one of the reference side edges at which one side edge of the sheet to be conveyed is registered.

Another biasing roller section 3 comprising three rollers 3*a* to 3*c* divided in the same manner as the above-mentioned biasing roller section 101 is also provided for urging the intermediate roller 2 against the conveying roller 1 to pinch the recording sheet 11 therebetween. The divided rollers 3*a* to 3*c* are rotatably mounted on corresponding arms 6*a*–6*c* pivotably mounted on a common shaft 5, respectively. Biasing springs 4*a* to 4*c* arranged between biasing bars 13*a* to 13*c* fixed to the corresponding rockable arms 6*a* to 6*c*and corresponding fixed plates 12*a* to 12*c* are provided for biasing the rollers 3*a* to 3*c* toward the intermediate roller 2.

As described in the Japanese Patent Laid-Open No. 63-8142 (which is published on Jan. 13, 1988 and corresponding to Japanese Patent Application No. 61-146094 filed on June 24, 1986) submitted by the same applicant as the present application, the intermediate roller 2 having a uniform diameter along an axial direction thereof and the biasing roller means 3 divided at a predetermined positions are provided for the purpose of pinching the recording sheet 11 with proper friction force. And, the biasing roller means 3 can be adjusted to obtain more uniform distribution of the biasing force; thus, when a small-sized recording sheet is conveyed along a conveying path with its one side edge being registered with one of the reference side edges, the skewing of the recording sheet being conveyed can be minimized or prevented effectively. Further, if there is no intermediate roller and segment areas for segmenting sections of the platen to be sucked in accordance with the width of the recording sheet and coincident with positions where the biasing rollers are not present, or positions between the biasing rollers, the recording sheet after being printed may be partly swelled at divided portions due to the ink and the like sticked thereon, thus floating the sheet portion above the platen. Accordingly, the intermediate roller is also adapted to prevent such floating of the recording sheet.

Therefore, in order to accurately convey any recording sheet from a large-sized sheet to a small-sized sheet without skew thereof, it is effective to provide the intermediate roller having the uniform diameter along the axial direction thereof and the biasing roller section having the divided rollers.

However, when the recording apparatus is so constructed as to conform any recording sheets even if the difference in size between the largest sheet and the smallest sheet is relatively large, it is desired that the distribution of the biasing force is strictly uniform with respect to all of the sizes of the sheets. Further, it has been highly requested that the recording sheet be conveyed with more and more accuracy, as the high density of the recording head has been progressed. For these reasons, it has been strongly requested that the distribution of the biasing force is more strictly uniformed with respect to all of the sized recording sheets. For example, an ink jet recording head which has recently been used as a recording or print head has been manufactured to have two hundred and fifty-six nozzles with dot density of 400 dots/inch (dpi). If such recording head is used, since the width of the head is 16.256 mm, it is necessary to maintain the accuracy of the feeding amount of the recording sheet on the order of 16.256 mm $\pm$0.015 mm so as to make the junctions between recorded image portions imperceptible. Further, it has been necessary to provide strict or critical uniformity of the distribution of the biasing force for obtaining the above-mentioned accuracy on the order of 16.256 mm $\pm$0.015 mm, when it is desired that the available width of the recording sheet be mated with all of the sizes thereof which differ relatively greatly, such as from A4 size (297 mm) to A2 size (594 mm).

However, in the earlier proposed (prior art) recording system shown in FIG. 9, the strict distribution of the biasing force cannot often be attained. For example, in FIG. 9, it is assumed that, by changing the positions at which the fixed plates 12*a*–12*c* are fixed, a biasing force of the biasing springs 4*a*–4*c* is adjusted to provide the uniform distribution of the biasing force for the A2 size recording sheet. FIG. 10A shows the relation between the conveying roller 1, intermediate roller 2, recording sheet 11 and biasing rollers 3*a*–3*c*, if the A4 size recording sheet is conveyed in such adjusted condition. In this case, since the intermediate roller 2 is not an absolute or true rigid body, as shown in FIG. 10A, the intermediate roller will be deformed in an area where the A4 size sheet does not exist, due to the fact that the portion of the intermediate in such area cannot resist against the biasing force $F'_B$ (FIG. 10B) of the biasing rollers 3*b* and 3*c*. Consequently, an end 11A of the recording sheet is subjected to concentrated stress. Thus, the distribution of the biasing force will be uneven as shown in FIG. 10B. Incidentally, in FIG. 10B, $W'_S$ represents the width of the recording sheet. If such uneven distribution of the biasing force is generated, as shown in FIG. 10C, when the recording sheet is conveyed after each scanning operation of the head unit 7, the recording sheet will hunt or meander each time, thus creating separation or overlap between the successively recorded image portions obtained by the successive scanning operations of the head unit 7. Incidentally, in FIG. 10C, $W'_R$ represents a width of the recorded image portion obtained by a single scanning operation of the head unit 7.

Thus, the present invention provides a sheet conveying apparatus which is improved to conform to the high accurate sheet conveyance which has been recently requested, and an image recording apparatus having such sheet conveying apparatus.

SUMMARY OF THE INVENTION

An object of the present invention is to provide a sheet conveying apparatus which can convey a sheet with high accuracy, and an image recording apparatus having such sheet conveying apparatus.

Another object of the present invention is to provide a sheet conveying apparatus which can convey a sheet more steadily, and an image recording apparatus having such sheet conveying apparatus.

Another object of the present invention is to provide a sheet conveying apparatus which can convey a sheet more stably without skewing of the sheet even when various sizes of sheets are conveyed, and an image recording apparatus having such sheet conveying apparatus.

Still another object of the present invention is to provide a sheet conveying apparatus which can solve the above-mentioned problems and can obtain a constantly uniform biasing force even when various sizes of sheets are conveyed, and an image recording apparatus having such sheet conveying apparatus.

DETAILED DESCRIPTION OF THE PREFERRED EMBODIMENTS

An ink jet printer incorporating a recording sheet conveying apparatus according to embodiments of the present invention, described herein below, comprises a biasing roller member provided for transmitting a conveying force from a conveying member to a recording sheet by biasing the recording sheet toward the conveying member along the conveying member for conveying the recording sheet and having biasing rollers formed by dividing in accordance with widths of the recording sheets selected by the printer, and bias controlling members provided in combination with the divided rollers respectively to selectively energize or disenergize (ON/OFF) the rollers to provide a biasing force selectively.

According to this embodiment, since the biasing roller member comprises the rollers formed by dividing the member in accordance with the sizes of the recording sheets and further the bias controlling members for selectively applying the biasing force of the divided rollers are provided, it is possible to always obtain the strictly uniform distribution of the biasing force regardless of the size of the recording sheet.

The present invention will now be fully explained with reference to the accompanying drawings.

Figure 7:
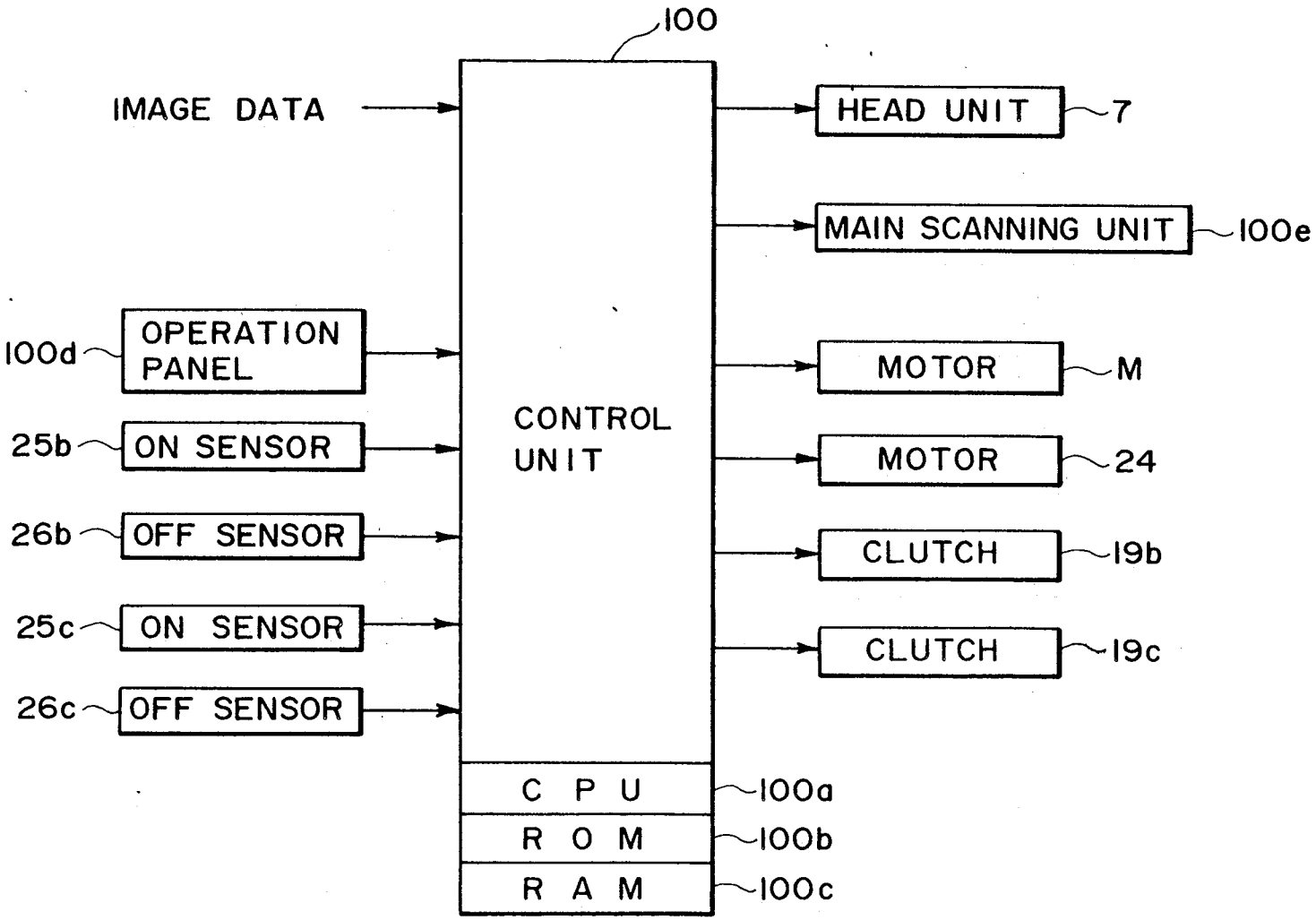
FIG. 7 is a block diagram of the apparatus shown in FIG. 1A.

First of all, FIG. 7 shows a block diagram of an embodiment according to the present invention which will be explained hereinafter.

A control unit 100 shown in FIG. 7 controls the whole image recording apparatus and the sheet conveying apparatus incorporated therein, which will be described later, and includes a CPU 100*a* such as a microprocessor, a ROM 100*b* for storing various data including a control program for the CPU 100*a* shown by a flow chart described later, a RAM 100*c* utilized as a work area of the CPU 100*a* and provided for temporarily storing various data, and the like. The control unit 100 also controls motors M, 24, clutches 19*b*, 19*c*, and a main scanning unit 100*e* for driving record operation for performing the ejection of ink droplets in response to reciprocating movement of the head unit 7 and to image information, on the basis of information signals from ON-sensors 25*b*, 25*c*, OFF-sensors 26*b*, 26*c*and an operation panel 100*d* which can perform, for example, designation of size of the recording sheet, designation of color, designation of mode (enlargement/reduction) and the like, as well as instruction input for starting the recording operation.

That is to say, the control unit 100 is a treatment section which performs the feed, line feed and ejection of the recording sheet by drivingly controlling a conveying system including the motor M for conveying the recording sheet, sets the biasing condition of the divided rollers by energizing or disenergizing (switching ON/OFF) the motor M and clutches 19*b*, 19*c* in accordance with the size of the recording sheet, drives the head unit 7 to start the recording operation on the basis of the image data after such setting, and activates the main scanning unit 100*e*, i.e, the motor 100*e* (FIG. 7) to cause the head unit to effect the scanning operation.

Figure 1A:
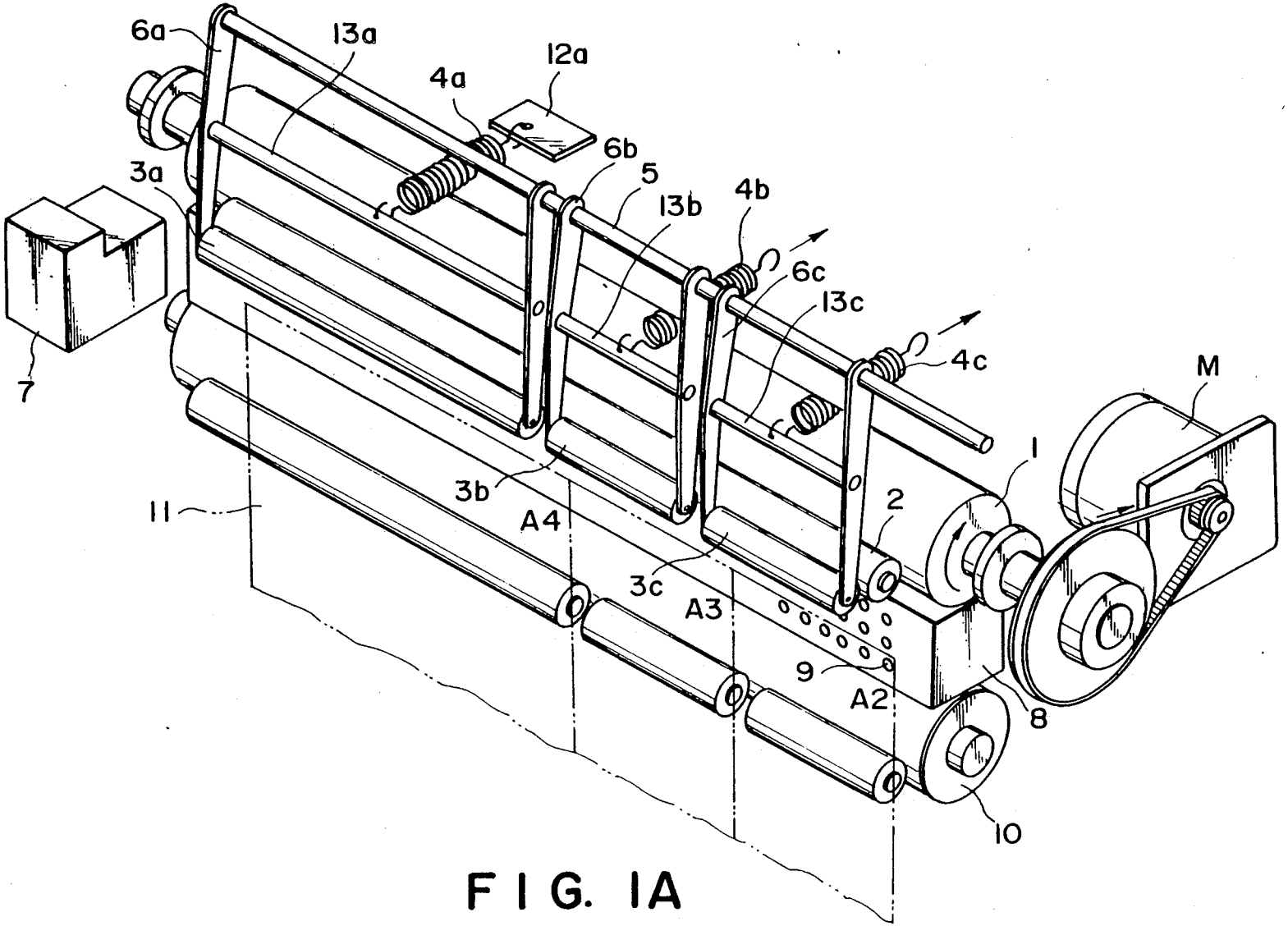
FIG. 1A is a schematic perspective view of an image recording apparatus incorporating a sheet conveying apparatus according to a preferred embodiment of the present invention.
Figure 1B:
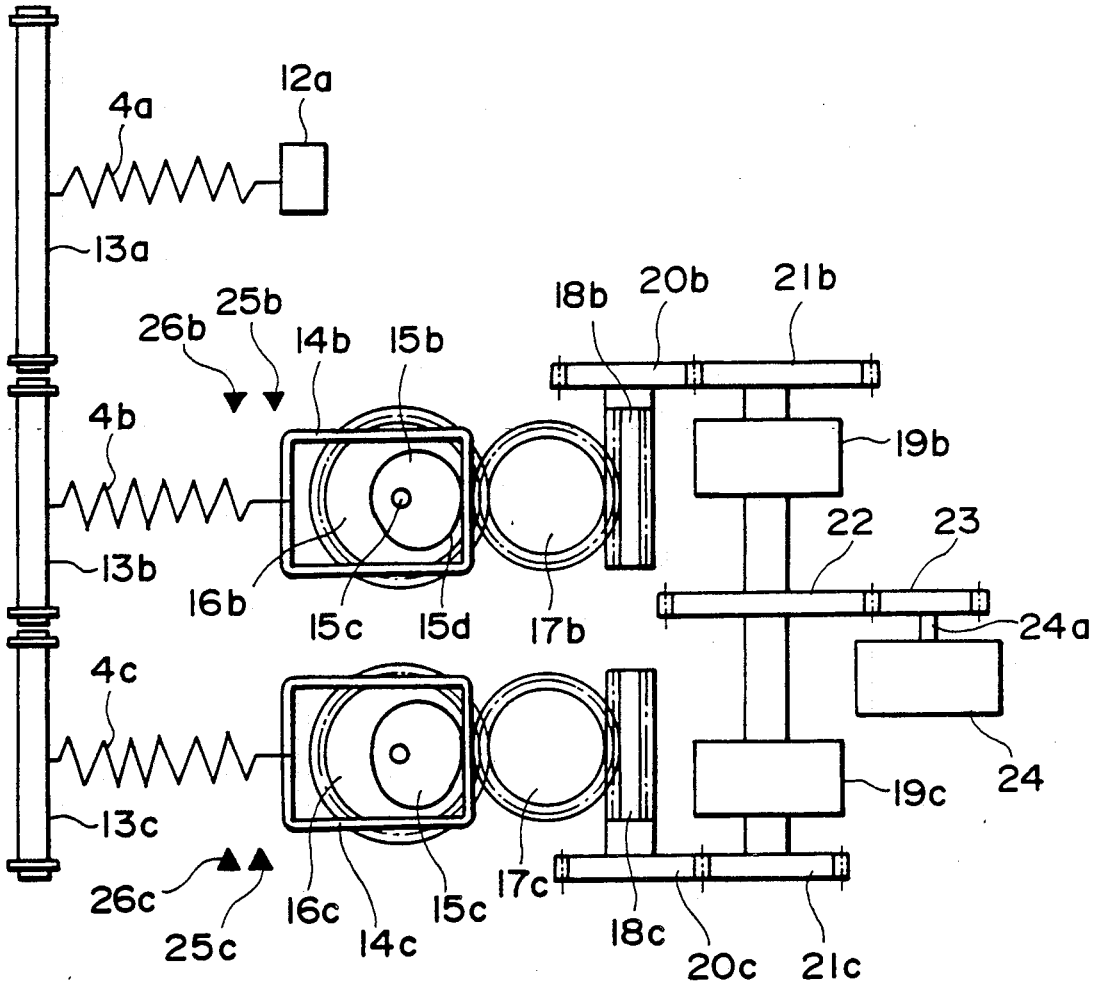
FIG. 1B is a schematic plan view of the apparatus of FIG. 1A.
Figure 9:
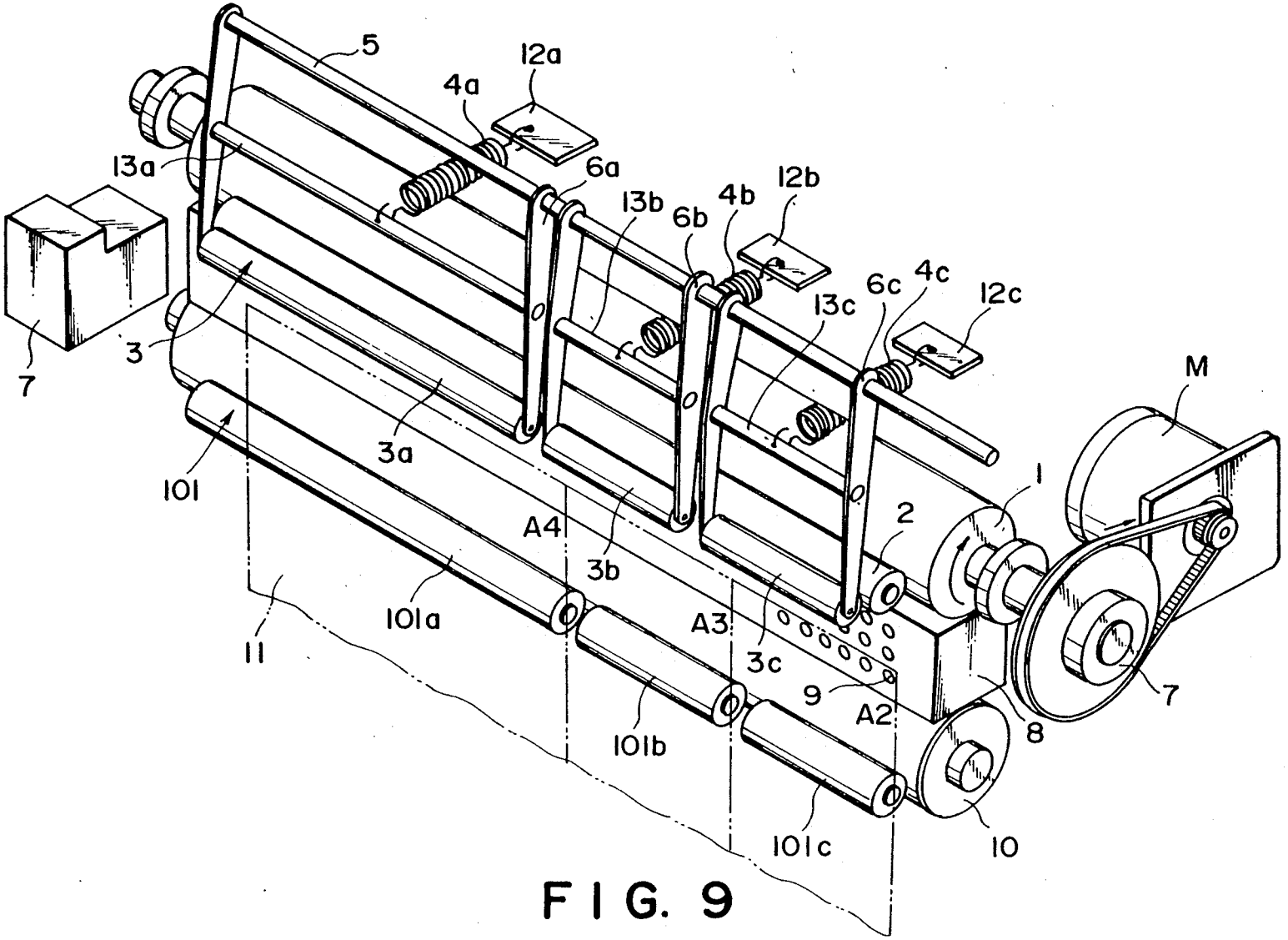
FIG. 9 is a perspective view of an example of an ink jet printer incorporating a sheet conveying apparatus, previously proposed by the same applicant as the present application and not yet publicly opened.

FIGS. 1A and 1B show an image recording apparatus incorporating a sheet conveying apparatus according to a first embodiment of the present invention. Elements of the system which may be constructed in the same manner as the corresponding elements shown in FIG. 9 are shown by the same reference numerals as those in FIG. 9.

In FIG. 1A, the recording sheets having the smallest A4 size, the largest A2 size and the intermediate A3 size are shown by a phantom line. A biasing roller section is divided into biasing rollers 3*a*, 3*b* and 3*c* at positions corresponding to A4 size width and A3 size width, respectively, so that these biasing rollers 3*a*, 3*b* and 3*c* act as A4, A3 and A2 sheet biasing rollers, respectively, and each can bias an intermediate roller 2. In the illustrated embodiment, since the smallest recording sheet is the A4 size sheet, a biasing spring 4*a* may have one end connected to a corresponding fixed plate 12*a* and the other end connected to a corresponding biasing bar 13*a*, thus applying the biasing force to the biasing roller 3*a* through the rocking movement of a corresponding arm 6*a*, in the same manner as the spring 4*a* of FIG. 9.

The biasing springs 4*b* and 4*c* associated with the A3 size sheet biasing roller 3*b* and the A2 size sheet biasing roller 3*c*, respectively, each has one end connected to the respective ON/OFF mechanism (described later) so that these springs can apply the biasing force to the corresponding biasing rollers as needed.

More particularly, as shown in FIG. 1B, one end of the biasing spring 4*b* is connected to a slider 4*b* which can be shifted between a right limited position (shown in FIG. 1B) where the biasing spring 4*b* is tensioned and a left limited position (when a cam 15*b* is rotated by 180° from the illustrated position) where the biasing spring 4*b* is released, in response to the positions of the cam 15*b*. Each of the limited positions are detected by an ON-sensor 25*b* and an OFF-sensor 26*b*, respectively. An operation gear 16*b* concentrically fixed to a cam shaft 15*c* of the cam 15*b* is rotated by a drive pinion 18*b* through an intermediate gear 17*b*. Further, the drive pinion 18*b* is rotated by the motor 24 through a gear 23 fixed to a motor shaft 24*a*, a gear 22, the clutch 19*b*, a gear 2 lb and a gear 20*b* fixed to the drive pinion 18*b*. Similarly, the biasing spring 4*c* is energized or disenergized (ON/OFF) through the similar power transmission path. That is to say, the biasing force can be applied to or released from the biasing spring 4*c* by means of the motor 24 through a mechanism comprising a slider 14*c*, cam 15*c*, gears 16*c*, 17*c*, drive pinion 18*c*, gears 20*c*, 21*c*, clutch 19*c* and gears 22, 23. The ON/OFF of the biasing spring 4*c* is also detected by an ON-sensor 25*c* and OFF-sensor 26*c*.

Figure 8:
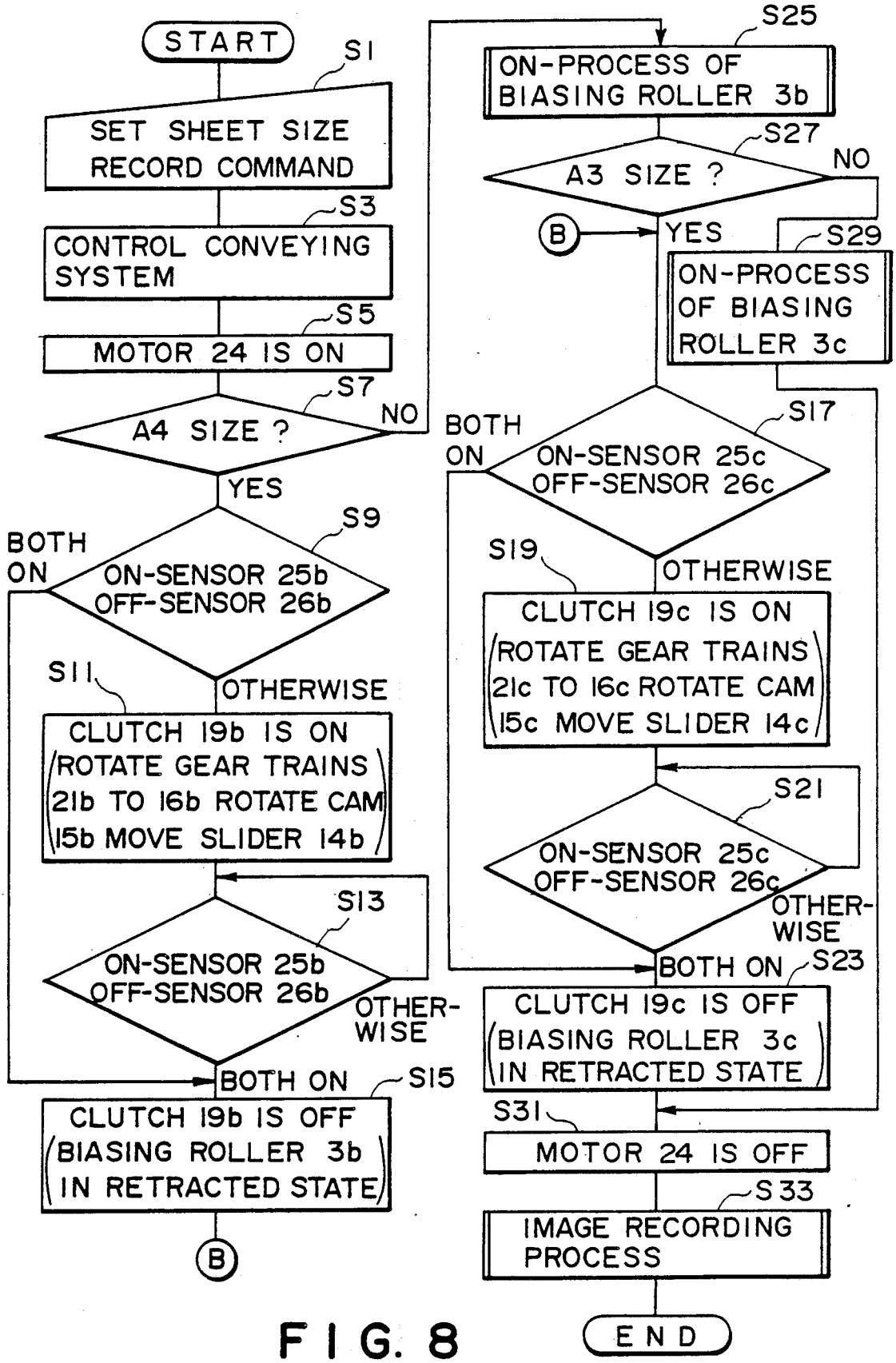
FIG. 8 is a flow chart showing the operation of the apparatus shown in FIG. 1A.

Next, an example of the operation of the recording apparatus according to the illustrated embodiment will be explained in connection with the flow chart shown in FIG. 8.

When the size of the recording sheet is designated by the use of the operation panel 100*d* and the record instruction is inputted (in a step S1), the conveyance system (motor M and the like) for supplying and conveying the recording sheet is started to drive (in a step S3). Then, the motor 24 is energized (ON) to set the ON/-OFF condition of the biasing rollers 3*b* and 3*c* in accordance with the designated size of the recording sheet (in a step S5), and it is determined whether the designated size is the A4 size or not (in a step S7).

When the size of the recording sheet to be used is the A4 size, only the biasing roller 3*a* always having the biasing force generated by the biasing spring 4*a* connected to the fixed plate 12*a* is used, while the other biasing rollers 3*b* and 3*c* are disenergized. That is to say, since the gear 22 is rotated by activating the motor 24, when both the ON-sensor 25*b* and OFF-sensor 26*b*, or the OFF-sensor 26*b* does not detect the slider 14*b* (in a step S9), the clutch 19*b* is energized, thus driving the gear train 21*b*–16*b*, thereby rotating the cam 15*b* (in a step S11) so that the slider 14*b* is shifted according to a profile 15*d* of the cam 15*b* until the biasing spring 4*b* is released; thereafter, when the ON-sensor 25*b* and the OFF-sensor 26*b* both detect the slider 14*b*, the clutch 19*b* is disenergized (in steps S13, S15), thus stopping the operation. When both the OFF-sensor 26*b* and the ON-sensor 25*b* do not detect the slider 14*b* from the beginning, although the biasing forces of the rollers 3*b* and 3*c* are not applied, in order to ensure such condition, the clutch 19*b* is disenergized (in the steps S9, S15).

The biasing spring 4*c* is similarly controlled. That is to say, when the ON-sensor 25*c* and the OFF-sensor 26*c* detect or do not detect the slider 14*c*, the clutch 19*c* is disenergized or energized, respectively, thus controlling the biasing force of the biasing spring 4*c* (in the steps S17–S23).

Figure 2A:
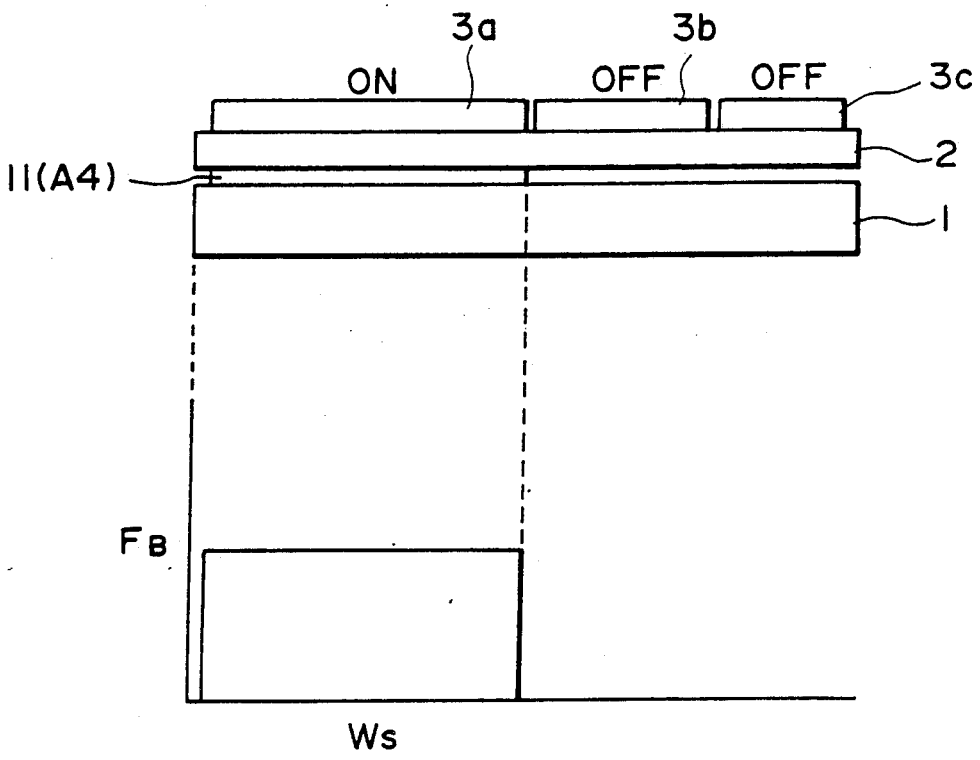
FIGS. 2A, 2B, 3 and 4 are explanatory views for explaining the operation of the apparatus shown in FIG. 1A.
Figure 2B:
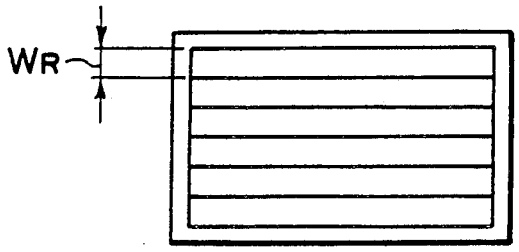

FIG. 2A shows a condition when only the biasing roller 3*a* applies its biasing force to the intermediate roller 2 in consequence of the control described above. In the apparatus from in FIG. 2, the portion of the intermediate roller 2 where the recording sheet does not exist is not deformed, thus providing the uniform distribution of the biasing force, since there is no concentrated stress acting on the edge portion of the recording sheet. Consequently, even a small sized recording sheet 11 can be conveyed highly accurately without the skewing of the sheet, thus improving record quality (FIG. 2B).

On other hand, when the sheet size other than the A4 size (i.e., the A3 size or the A2 size in illustrated embodiment) is designated in the step S7, the biasing roller 3*b* is energized in the manner described above (in a step S25). That is to say, when both the ON-sensor 25*b* and the OFF-sensor 26*b* are OFF, the clutch 19*b* is disenergized. In this case, if the A3 size is designated (in a step S27), procedures for disenergizing the biasing roller 3*c* are carried out (in the steps S17–S23).

Figure 3:
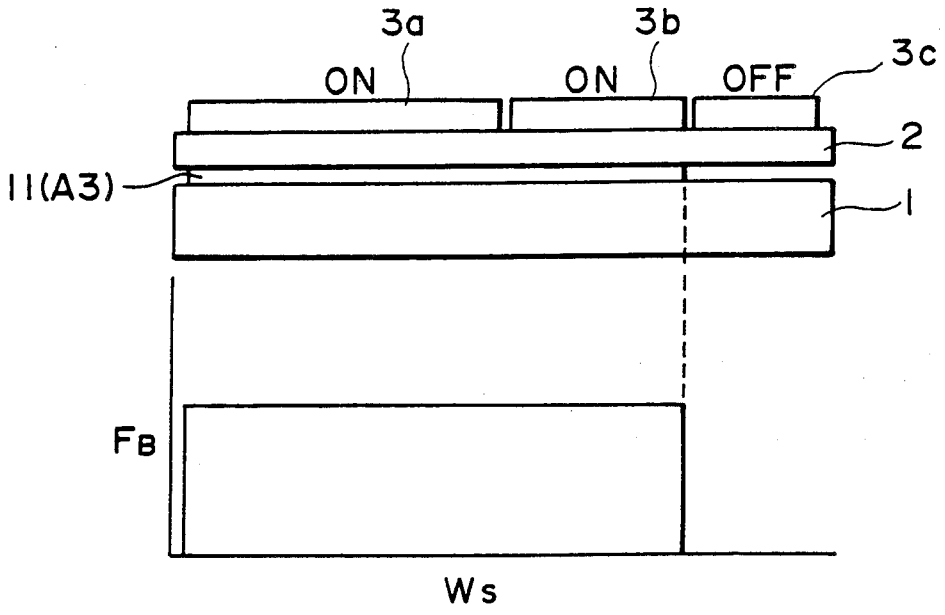

More particularly, when the recording sheet is the A3 size, the clutch 19*b* and the clutch 19*c* are energized and disenergized, respectively, to set a position where the slider 14*b* is not detected by the ON-sensor 25*b* and the OFF-sensor 26*b*, and a position where the slider 14*c* is detected by the ON-sensor 25*c* and the OFF-sensor 26*c*, respectively, thereby applying the biasing force to the intermediate roller 2 by the biasing roller 3*a* alone and by both of the biasing rollers 3*a*, 3*b*, respectively. Consequently, as shown in FIG. 3, it is possible to obtain the uniform distribution of the biasing force.

Figure 4:
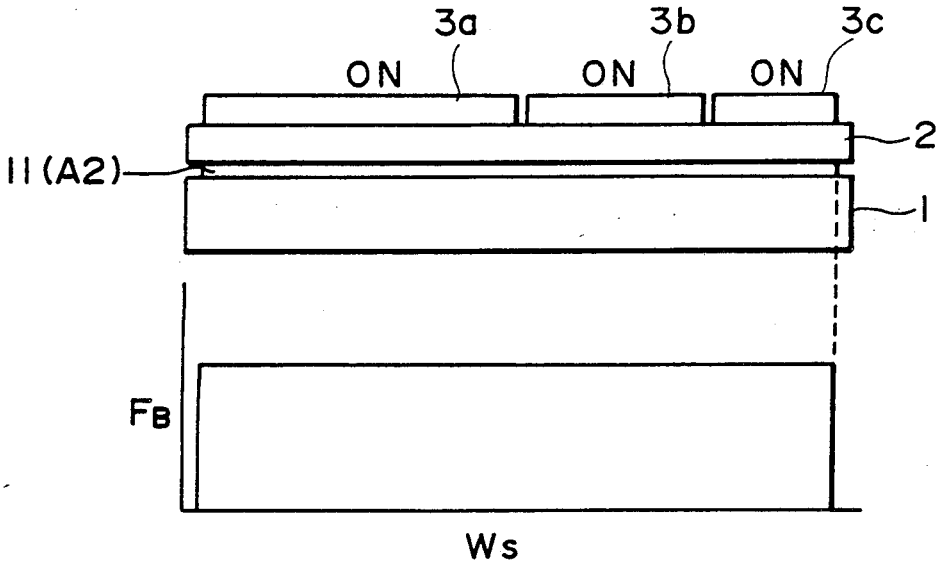

When the A2 size recording sheet 11 is selected, the biasing roller 3*c* is also energized in a step S29. That is to say, also in this case, as shown in FIG. 4, it is possible to obtain the uniform distribution of the biasing force by energizing or disenergizing the clutch 19*b* and the clutch 19*c* to apply the biasing force to all the biasing rollers 3*a*–3*c*.

It should be understood that the biasing springs 4*a*–4*c* each has a spring constant so that the uniform biasing force is applied to the recording sheet 11 on the whole width thereof.

After the biasing rollers are set as desired, the motor 24 is disenergized (in a step S31), and the head unit 7 and the main scanning unit 100*e* are driven, thus recording the image on the recording sheet while performing the repeated line feeds (in a step S33).

Figure 5:
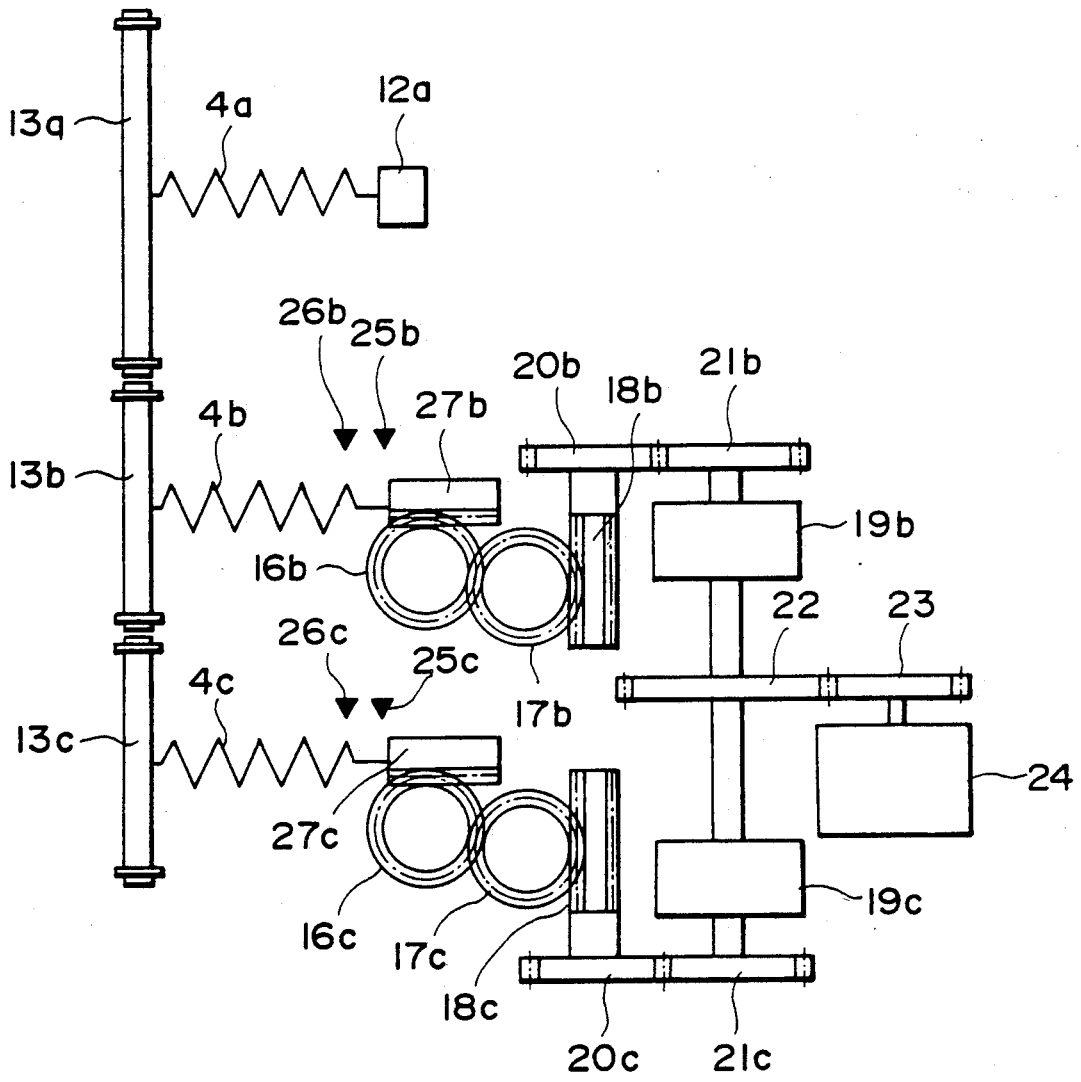
FIG. 5 is a schematic plan view of an image recording apparatus incorporating a sheet conveying apparatus according to another embodiment of the present invention.

FIG. 5 shows an ON/OFF mechanism for applying and releasing (ON/OFF) the biasing force with respect to the biasing rollers, according to another embodiment of the present invention. In this embodiment, in place of the cams 15*b*, 15*c* and slider 14*b*, 14*c* in the previous embodiment shown in FIG. 1B, there are provided racks 27*b* and 27*c* which are connected to the biasing springs 4*b* and 4*c*, respectively, and which are meshed with the operation gears 16*b* and 16*c*, respectively, so that the racks are shifted between the respectively limited positions by the rotation of the operation gears, thereby selectively applying and releasing (ON/OFF) the biasing force with respect to the biasing rollers 4*b* and 4*c*. The remaining construction of the ON/OFF mechanism of this embodiment is the same as that of the first embodiment shown in FIG. 1B, and the technical effect obtainable from this embodiment is the same as that obtainable from the first embodiment.

Figure 6:
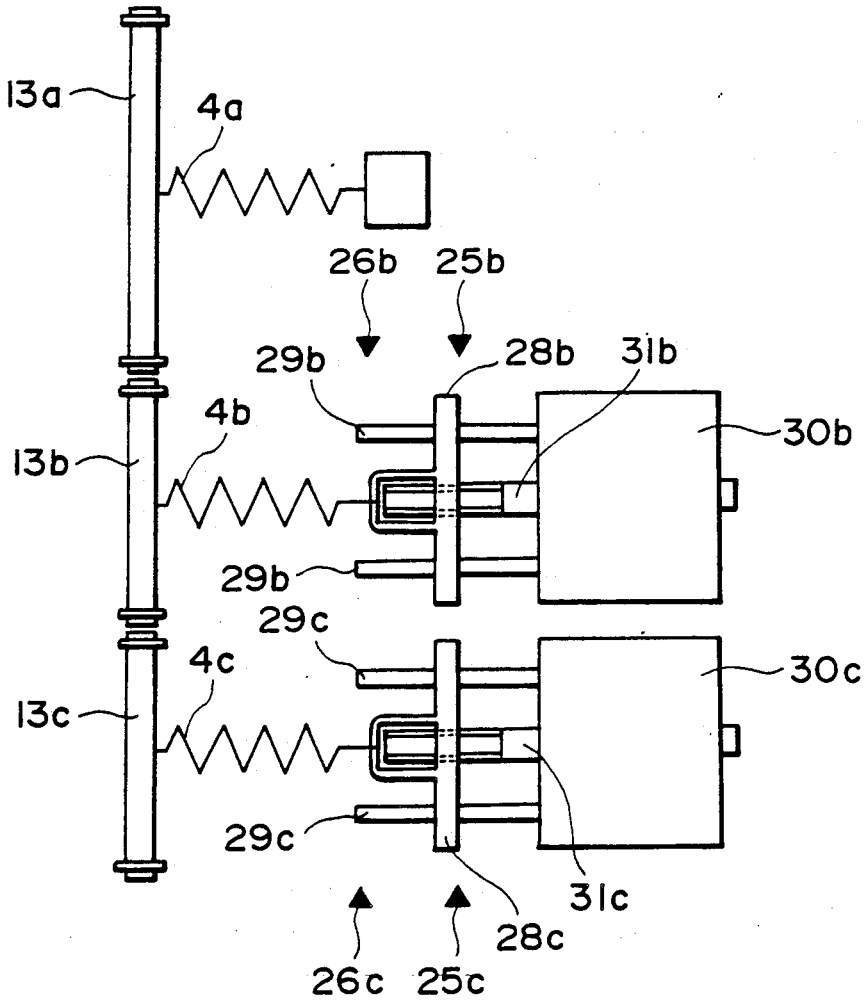
FIG. 6 is a schematic plan view of an image recording apparatus incorporating a sheet conveying apparatus according to other embodiment of the present invention.

FIG. 6 shows an ON/OFF mechanism according to a further embodiment of the present invention.

In this embodiment, one end of the biasing spring 4*b* is connected to a slider 28*b*. The slider 28*b* slidably mounted on guides 29*b* so as to be shifted in leftward and rightward directions (FIG. 6) along the guides. The slider 28*b* is provided with a central female threaded bore meshed with a male threaded portion formed on a motor shaft 31*b* of a motor 30*b*. Thus, the slider 28*b* is shifted horizontally when the motor shaft 31*b* is rotated by energizing the motor 30*b*.

When the motor 30*b* is stopped immediately after the ON-sensor 25*b* detects the slider 28*b*, the biasing roller 3*b* can bias the intermediate roller 2. On the other hand, when the motor is stopped immediately after the slider is detected by the OFF-sensor 26*b*, the biasing roller 3*b* does not bias the intermediate roller. Of course, the slider 28*b* can be shifted in either a leftward direction or rightward direction by reversing the direction of rotation of the motor shaft 31*b*.

Similarly, with respect to the biasing roller 3*c* , a similar ON/OFF mechanism (as that associated with the roller 3*b*) comprising guides 29*c*, slider 28*c*, sensors 26*c*, 25*c*, motor shaft 31*c* and motor 30*c* is provided for applying and releasing the biasing force to and from the biasing roller 3*c*. By properly activating such ON/OFF mechanism in accordance with the size of the recording sheet, the same technical effect as that in the case of the two previous embodiments can be obtained.

Further, in this embodiment, in place of the motors 30*b* and 30*c*, appropriate solenoids (not shown) may be connected to the corresponding sliders 28*b* and 28*c* directly or through a mechanical force increasing mechanism such as a lever, thereby obtaining the same technical effect as the previous ones and eliminating the use of the sensors 25*c* and 26*c*.

It should be understood that the ON/OFF mechanism for selectively applying and releasing (ON/OFF) the biasing force with respect to the biasing rollers are not limited to the three examples illustrated above, and can be modified or altered in various ways.

Further, in the illustrated embodiments, the recording sheets were explained as the A4 size sheet, A3 size sheet and A2 size sheet; of course, however, the sizes of the recording sheet, the number of the divided rollers and the dividing positions in correspondence to the sizes of the sheet can be selected as desired.

Further, the instruction means for the ON/OFF mechanism for selectively energizing and disenergizing (ON/OFF) the biasing rollers may comprise selection keys or selection switches provided in correspondence to the number of sizes of the sheet, capable of selecting the desired sheet by an operator, or may comprise keys or switches providing the number of divided rollers.

In addition, the control means for controlling the above-mentioned ON/OFF mechanism according to the instruction may be of any one of various forms or configurations; for example, such controlling operation may be carried out by the CPU for controlling the operation of the whole system, or may be performed by a hardware logic circuit for controlling the operation of the above mechanism in response to key or switch inputs and the like.

Furthermore, in the illustrated embodiments, an example of the ON/OFF mechanism being provided in connection with the biasing roller means 3 associated with the conveying roller 1 was described. However, it should be noted that the ON/OFF mechanism may be provided in connection with the biasing roller means 101 associated with the sheet feed roller 10, or various rollers (in the system) associated with the recording sheet conveying operation.

Figure 10A:
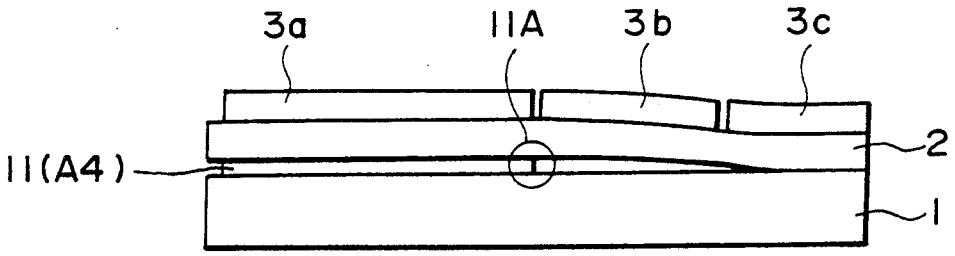
FIGS. 10A–10C are explanatory views for explaining the operation of the apparatus shown in FIG. 9.
Figure 10B:
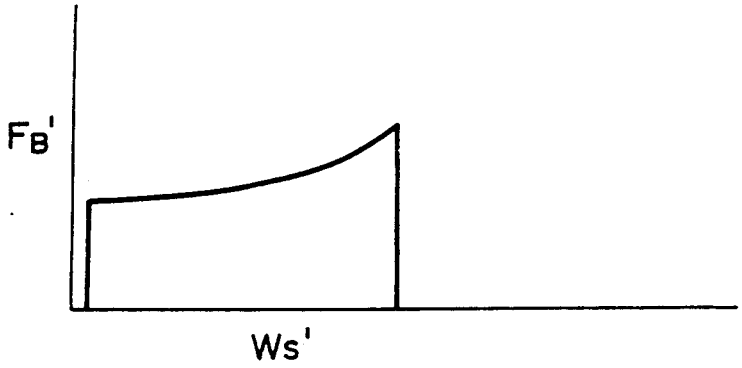
Figure 10C:
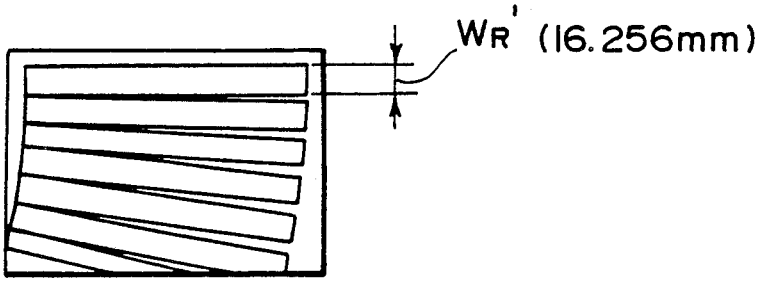

Further, in the illustrated embodiments, an example of the present invention being applied to a system having the intermediate roller was described. However, even when the system is not provided with the intermediate roller, since there often arises the problem mentioned above in connection with FIG. 10A due to the fact that any roller is subjected to the concentrated stress to deform the roller in consequence of the size of the recording sheet to be used, it is considerably effective to provide the ON/OFF mechanism, as constructed in the illustrated embodiments, for controlling the biasing force with respect to each of the divided biasing rollers.

In addition, in the illustrated embodiment, an example of the recording sheet being conveyed was described. However, it should be noted that the sheet conveying apparatus according to the present invention is also applicable to an apparatus for conveying a document sheet, as previously stated. Further, it is to be understood that the image recording system according to the present invention can be applied to an ink jet recording system, a thermal recording system, an electrophotographic recording system, a laser recording system or the like.

Furthermore, the sheet conveying member is not limited to a roller, but may comprise an endless belt entrained around driving/driven pulleys and the like.

In addition, the biasing force changing means is not limited to the illustrated biasing rollers (separation from or abutment against the intermediate roller), but may comprise, for example, leaf spring members (separation or abutment) and the like.

According to the illustrated embodiments, since the biasing force of the biasing roller(s) other than the biasing roller(s) engaged with the conveyance of the recording sheet is released, the recording sheet is not subjected to the concentrated stress at its end, whereby it is possible to obtain the uniform distribution of the biasing force for all of the recording sheet. Consequently, it is possible to convey the recording sheet highly accurately without the hunting of the sheet, for recording sheets from a large size to a small size.

As mentioned above, according to the present invention, a sheet conveying apparatus, and an image recording apparatus having such sheet conveying apparatus, which can convey all of the recording sheet having various sizes with high accuracy are provided.

What is claimed is:

1. A sheet conveying apparatus comprising:

a first roller having a periphery continuous along the entire width of a sheet to be conveyed, said first roller being rotatable to convey the sheet;

a second roller having a periphery continuous along the entire width of the sheet to be conveyed, said second roller being rotatable to pinch the sheet in cooperation with said first roller; and a plurality of rotary members contacting said second roller and pressing said second roller to said first roller, wherein said rotary members are provided along the width of the sheet and a pressing force from said rotary members is adjustable in accordance with the size of the sheet to be conveyed.

2. A sheet conveying apparatus according to claim 1, wherein said second roller has a periphery greater than the width of a widest sheet to be conveyed.

3. A sheet conveying apparatus according to claim 1, wherein at least one of said rotary members has a roller member.

4. A sheet conveying apparatus according to claim 1, wherein each of said rotary members is capable of releasing the pressing force thereof.

5. A sheet conveying apparatus according to claim 1, wherein the pressing force of said rotary members in contact with a part of said second roller is released when said second roller is not in contact with the sheet to be conveyed.

6. A sheet conveying apparatus according to claim 1, further comprising adjusting means for adjusting the pressing force of each f said rotary members.

7. A sheet conveying apparatus according to claim 6, further comprising control means for controlling said adjusting means in accordance with the size of the sheet to be conveyed.

8. A sheet conveyed apparatus according to claim 7, further comprising signal generating means for generating a size signal in accordance with the size of the sheet to be conveyed, wherein said control means controls said adjusting means in response to said size signal generated by said signal generating means.

9. A sheet conveying apparatus according to claim 8, further comprising size designating means for designating a size of the sheet to said signal generating means.

10. A sheet conveying apparatus comprising:

a first roller having a periphery continuous along the entire width of a sheet to be conveyed, said first roller being rotatable to convey the sheet;

a second roller having a periphery continuous along the entire width of the sheet to be conveyed, said second roller being rotatable to pinch the sheet in cooperation with said first roller;

a plurality of rotary members contacting said second roller and pressing said second roller to said first roller, said rotary members being arranged along a rotary axis of said second roller;

adjusting mans for adjusting the pressing force of each of said rotary members;

signal generating means for generating a size signal in accordance with the size of the sheet to be conveyed; and control means for controlling said adjusting means in response to said size signal generated by said signal generating means.

11. A sheet conveying apparatus according to claim 10, wherein each of said rotary members is capable of releasing the pressing force thereof.

12. A sheet conveying apparatus according to claim 10, wherein said control means releases the pressing force of said rotary members in contact with a part of said second roller when said second roller is not in contact with the sheet to be conveyed.

13. A sheet conveyed apparatus according to claim 10, further comprising size designating means for designating a size of the sheet to said signal generating means.

14. An image recording apparatus comprising:

a first roller having a periphery continuous along the entire width of a sheet to be conveyed, said first roller being rotatable to convey the sheet;

a second roller having a periphery continuous along the entire width of the sheet to be conveyed, said second roller being rotatable to pinch the sheet in cooperation with said first roller;

a plurality of rotary members contacting said second roller and pressing said second roller to said first roller, said rotary members being arranged along a rotary axis of said second roller;

adjusting means for adjusting the pressing force of each of said rotary members; and recording means provided upstream of the conveying direction of said first and second rollers for recording an image on the sheet to be conveyed.

15. An image recording apparatus according to claim 14, wherein said recording means is an ink jet recording head.

16. An image recording apparatus according to claim 14, wherein said recording means is an ink jet nozzle.

* * * * *

UNITED STATES PATENT AND TRADEMARK OFFICE

CERTIFICATE OF CORRECTION

PATENT NO. : 5,000,439

DATED : March 19, 1991

INVENTOR(S) : Atsutomo Yoshizawa

It is certified that error appears in the above-identified patent and that said Letters Patent is hereby corrected as shown below: Title page:

AT [30], FOREIGN APPLICATION PRIORITY DATA:

Insert --November 12, 1987 [JP] Japan .... 62-284279
November 4, 1988 [JP] Japan .... 63-277402--

COLUMN 1:

Line 27, "Then" should read --Then,--;

Line 47, "a" should read --an--;

Line 48, "a" should read --an--; and

Line 60, "6cand" should read --6c and--.

COLUMN 2:

Line 47, "±0.015 mm so" should read ±0.015 mm, so--.

COLUMN 3:

Line 3, "intermediate" should read --intermediate roller--;

Line 4, "force $F'_B$" should read --force $F_{B'}$--;

Line 8, "$W'_S$" should read --$W_{S'}$--;

Line 17, $W'_R$ should read --$W_{R'}$--.

COLUMN 4:

Line 53, "26cand" should read --26c and--;

UNITED STATES PATENT AND TRADEMARK OFFICE

CERTIFICATE OF CORRECTION

PATENT NO. : 5,000,439

DATED : March 19, 1991

INVENTOR(S) : Atsutomo Yoshizawa

It is certified that error appears in the above-identified patent and that said Letters Patent is hereby corrected as shown below:

COLUMN 5:

Line 32, "slider 4b" should read --slider 14b--; and

Line 45, "gear 2 1b" should read --gear 21b--.

COLUMN 6:

Line 30, "from in" should read --of--;

Line 40, "in illustrated" should read --in the illustrated--; and

Line 41, "the" (first occurrence) should be deleted.

COLUMN 7:

Line 29, "slidably" should read --is slidably--.

COLUMN 9:

Line 7, "sheet" should read --sheets--;

Line 37, "said second roller" should read --said part of said second roller--;

UNITED STATES PATENT AND TRADEMARK OFFICE

CERTIFICATE OF CORRECTION

PATENT NO. : 5,000,439

DATED : March 19, 1991

INVENTOR(S) : Atsutomo Yoshizawa

It is certified that error appears in the above-identified patent and that said Letters Patent is hereby corrected as shown below:

Line 41, "f" should read --of--; and

Line 46, "sheet conveyed apparatus" should read --sheet conveying apparatus--.

COLUMN 10:

Line 29, "sheet conveyed apparatus" should read --sheet conveying apparatus--;

Line 50, "is" should read --comprises--; and

Line 53, "is" should read --comprises--.

Signed and Sealed this

Twenty-seventh Day of October, 1992

*Attest:*

DOUGLAS B. COMER

*Attesting Officer*

*Acting Commissioner of Patents and Trademarks*

UNITED STATES PATENT AND TRADEMARK OFFICE

CERTIFICATE OF CORRECTION

PATENT NO. : 5,000,439

DATED : March 19, 1991

INVENTOR(S) : Atsutomo Yoshizawa

It is certified that error appears in the above-identified patent and that said Letters Patent is hereby corrected as shown below:

COLUMN 10:

Line 27, "said second roller" (second occurrence) should read --said part of said second roller--.

Signed and Sealed this

Twenty-third Day of November, 1993

Bruce Lehman

BRUCE LEHMAN

*Commissioner of Patents and Trademarks*

*Attest:*

*Attesting Officer*